US010510502B2

(12) United States Patent
Takeda

(10) Patent No.: US 10,510,502 B2
(45) Date of Patent: Dec. 17, 2019

(54) THERMAL PROTECTOR

(71) Applicant: Uchiya Thermostat Co., Ltd., Saitama (JP)

(72) Inventor: Hideaki Takeda, Saitama (JP)

(73) Assignee: Uchiya Thermostat Co., Ltd., Saitama (JP)

( * ) Notice: Subject to any disclaimer, the term of this patent is extended or adjusted under 35 U.S.C. 154(b) by 0 days.

(21) Appl. No.: 15/544,059

(22) PCT Filed: Oct. 19, 2015

(86) PCT No.: PCT/JP2015/079487
§ 371 (c)(1),
(2) Date: Jul. 17, 2017

(87) PCT Pub. No.: WO2016/125343
PCT Pub. Date: Aug. 11, 2016

(65) Prior Publication Data

US 2017/0365428 A1 Dec. 21, 2017

(30) Foreign Application Priority Data

Feb. 4, 2015 (JP) ..... 2015-020194

(51) Int. Cl.
*H01H 37/60* (2006.01)
*H01H 37/54* (2006.01)
(Continued)

(52) U.S. Cl.
CPC ..... *H01H 37/60* (2013.01); *H01H 37/52* (2013.01); *H01H 37/54* (2013.01); *H01H 9/30* (2013.01);
(Continued)

(58) Field of Classification Search
CPC ..... H01H 37/52; H01H 37/5418; H01H 37/5409; H01H 37/60; H01H 2037/523;
(Continued)

(56) References Cited

U.S. PATENT DOCUMENTS

2003/0058079 A1 3/2003 Sullivan et al.
2004/0075526 A1 4/2004 Takeda
(Continued)

FOREIGN PATENT DOCUMENTS

CN 1503980 A 6/2004
JP 49130375 U 11/1974
(Continued)

OTHER PUBLICATIONS

"International Application No. PCT/JP2015/079487, International Search Report dated Dec. 22, 2015", w/ English Translation, (dated Dec. 22, 2015), 5 pgs.
(Continued)

*Primary Examiner* — Jacob R Crum
(74) *Attorney, Agent, or Firm* — Schwegman Lundberg & Woessner, P.A.

(57) ABSTRACT

A thermal protector includes, in a fixed manner, a first terminal and a second terminal that are respectively connected to external circuits, at lower left/right ends of the longitudinal directions of a base, and a right end at which a movable plate and a bimetal are superimposed is fixed to the right end of the upper surface of the base and is connected to the second terminal. A fixed contact is fixed to an internal end of the first terminal that is exposed in the left end of the base. A movable contact is fixed at a position facing the fixed contact on the lower surface of the left end of the movable plate. A partition wall that encloses the movable contact and the fixed contact from three directions is provided and bent plate planes are formed on both sides of the movable plate
(Continued)

in the vicinity of the movable contact. The bent plate planes adjust the flow direction of hot air in cooperation with the partition wall so as to prevent a malfunction of a breaking arc flying to surrounding conductive members.

5 Claims, 4 Drawing Sheets

(51) Int. Cl.
*H01H 37/52* (2006.01)
*H01H 9/30* (2006.01)
*H01H 9/46* (2006.01)

(52) U.S. Cl.
CPC ..... *H01H 9/46* (2013.01); *H01H 37/5418* (2013.01); *H01H 37/5427* (2013.01); *H01H 2037/5481* (2013.01); *H01H 2231/012* (2013.01); *H01H 2239/044* (2013.01)

(58) Field of Classification Search
CPC ..... H01H 2037/525; H01H 2037/5481; H01H 9/30; H01H 9/46; H01H 37/54; H01H 37/5427; H01H 2231/012; H01H 2239/044
USPC ..... 337/109, 111, 349, 379
See application file for complete search history.

(56) References Cited

U.S. PATENT DOCUMENTS

| | | | | |
|---|---|---|---|---|
| 2004/0100351 | A1* | 5/2004 | Unno | F04C 23/008 337/100 |
| 2010/0026446 | A1* | 2/2010 | Takeda | H01H 37/5418 337/372 |
| 2010/0308954 | A1* | 12/2010 | Takeda | H01H 37/32 337/398 |
| 2012/0212210 | A1* | 8/2012 | Takeda | H01H 1/504 323/370 |
| 2014/0049355 | A1* | 2/2014 | Takeda | H01H 37/54 337/365 |

FOREIGN PATENT DOCUMENTS

| | | | |
|---|---|---|---|
| JP | 60115434 | U | 8/1985 |
| JP | 06251674 | A | 9/1994 |
| JP | 07192595 | A | 7/1995 |
| JP | 09120763 | A | 5/1997 |
| JP | 2002289076 | A | 10/2002 |
| JP | 2003141977 | A | 5/2003 |
| JP | 2005166431 | A | 6/2005 |
| JP | 2006196372 | A | 7/2006 |
| WO | WO-02071431 | A1 | 9/2002 |

OTHER PUBLICATIONS

"International Application No. PCT/JP2015/079487, Written Opinion dated Dec. 22, 2015", (dated Dec. 22, 2015), 4 pgs.
"Chinese Application Serial No. 201580073482.6, Office Action dated Jul. 2, 2018", w/ English Translation, (dated Jul. 2, 2018), 12 pgs.
"Chinese Application Serial No. 201580073482.6, Office Action dated Feb. 19, 2019", w/ English Translation, (dated Feb. 19, 2019), 10 pgs.
"Chinese Application Serial No. 201580073482.6, Office Action dated Sep. 2, 2019", w/ English Translation, (dated Sep. 2, 2019), 10 pgs.
"Japanese Appliccation Serial No. 2016-573176, Notification of Refusal dated Sep. 3, 2019", w/ English Translation, (dated Sep. 3, 2019), 10 pgs.

* cited by examiner

THERMAL PROTECTOR

PRIORITY APPLICATIONS

This application is a U.S. National Stage Filing under 35 U.S.C. 371 from International Application No. PCT/JP2015/079487, filed on 19 Oct. 2015, and published as WO2016/125343 on 11 Aug. 2016, which claims the benefit of priority to Japanese Application No. 2015-020194, filed on 4 Feb. 2015; which applications and publication are incorporated herein by reference in their entirety.

FIELD

The present invention is related to a thermal protector embedded in an electrical apparatus that generates hot air, and more specifically to a thermal protector that prevents adverse effects on surrounding members caused by an arc that is generated between contacts when the contacts of an electrical apparatus are open.

BACKGROUND

A thermal protector is conventionally known that is embedded in hot air generation device such as a hair dryer, fan heater, a popcorn machine, etc. so as to open and close contacts. Usually, such a thermal protector has, in an integrated manner, a bimetal as a thermally actuated element in order to prevent overheating in the hot air generation device.

Also, for example a flowing air detection switch, an air heater and a hair dryer that use this switch are proposed, wherein the flowing air detection switch forcibly opens the movable contact with respect to the fixed contact when there is no flowing air, independently from the thermal actuation of a bimetal is provided with a movable flowing air blade that makes the movable contact free when receiving a prescribed flow amount of flowing air, causes hot air to flow by driving a heater by bringing the contacts into contact with each other only when flowing air is generated, and blocks a current by opening the contacts through the thermal actuation of the bimetal in response to overheating (See Patent Document 1, for example).

Note that in the sixth embodiment in which the bimetal described by this Patent Document 1 is embedded, it is argued that the portions of the movable contact and the fixed contact are enclosed by an enclosure frame so as to prevent the entering of dust such as powder dust, cotton dust, etc. and thereby contact failure can be prevented as shown in FIG. 14 and FIG. 15.

Incidentally, when for example a hair dryer is set to be used with a current corresponding to the limit of the power source wiring, a large amount of flowing air is necessary in order to set it to blow a heat quantity of for example 1500 W as warm flowing air. In such a case, generally, the cross-sectional area of the air outlet of hair dryers is reduced in order to increase the flow rate.

When such a hair dryer is provided with a thermal protector in it, the thermal protector is usually fixed to a heat-resistant insulation plate such as a mica insulation plate by eyelets etc. through swaging together with Nichrome wire, which is a heat generation body, and is connected electrically to the plate.

Nichrome wire is wound, in a spiral manner, on the outer periphery of a mica insulation plate that is formed in cross directions or hexagonal directions and thereby forms a heat generation unit, and the spiral internal space becomes a flow channel of hot air. The thermal protector is arranged in the flow channel of the hot air and is attached to the mica insulation plate by being directly connected to Nichrome wire in series in wiring.

Incidentally, hair dryers enter an abnormal state in some cases. Examples of such states are an abnormal increase in the internal temperature caused by a decrease in the airflow amount, a case when abnormal heat generation is caused when for example an appliance that can switch voltages for use outside of Japan is used and a mistake occurs in the selection of voltages so that a low voltage is set while the appliance is used with a high voltage, etc.

In such a case, the thermal protector operates so as to block the passage of a current to the Nichrome wire in order to stop heat generation and bring the hair dryer into a safe state. When a thermal protector is attached to a mica insulation plate as described above, a highly effective thermal response is necessary, and accordingly it is provided with the switch structures of a bimetal, a contact, etc. being exposed.

Also, a thermal protector is arranged near the center (root) of the cross directions or the hexagonal directions of a mica insulation plate in order to secure an appropriate insulation distance from the Nichrome wire. When an abnormality such as the above examples occurs and an abnormal temperature is detected in this state, the bimetal is inverted to lift the movable plate so as to open the space between the contacts and block the current.

When for example a high current is flowing upon this blockage of the current, a large breaking arc occurs. Further, because when there is a high current hot air flows in a large flow amount, complicated airstreams are formed by being influenced by the installation positions and installation states of internal components in the hair dryer.

Also, a thermal protector is arranged near the outlet of hot air in many cases although a thermal protector is attached at various positions depending upon the structures of hair dryers etc. The flow rate of air is high in the vicinity of the outlet of hot air as described above.

Because of this, a breaking arc of a high current is often expanded by flowing air from the space between contacts as if it were blown away, depending upon the timing of the occurrence. As a result, a breaking arc having occurred between contacts moves to a conductive portion that is different from a contact, and starts causing damages by due to a high temperature of the arc at a location such as for example the tip of the movable plate.

Further, a breaking arc does not stay in a thermal protector but sometimes files, due to flowing air, from for example the movable contact that instantaneously jumps upon the opening of the contact, to a Nichrome wire that is in the vicinity of the movable contact. This easily occurs when the difference between the potential of a movable plate and the potential of the Nichrome wire is large.

PRIOR ART DOCUMENT

Patent Document [Patent Document 1] Japanese Laid-open Patent Publication No. 09-120763

SUMMARY

Incidentally, an electrical apparatus that generates hot air of a large flow rate by using a high current is generally known in countries where a voltage of 250V is used as a home electricity source. In case of a thermal protector arranged and used in the flow channel of hot air of a large flow rate, a high-temperature breaking arc occurs between contacts by the opening of contact upon breaking a high current of the apparatus.

A breaking arc occurring through current breakage in a high current/large amount of flowing air of a thermal protector as described above causes various malfunctions when it flies to a conductive portion that is not a contact. Because the portions of the movable contact and the fixed contact are enclosed by an enclosure frame in the technique described in Patent Document 1, it may be thought that it is possible to prevent an arc from flying to a conductive portion in addition to the entering of powder dust.

However, when the flow channel of hot air is narrow and a space in which a thermal protector is provided is small, there is not a spatial margin in which a large and effective partition wall such as an enclosure frame described in FIG. 14/FIG. 15 of Patent Document 1 is formed around a contact in order to prevent an arc from flying, which is problematic.

More than that, it is completely impossible for a thermal protector of a shape resulting from attaching a member such as a movable blade that is as large as a switch body to be attached to the switch body at a right angle in a narrow and small provision space.

In order to prevent an arc from flying to Nichrome wire, a thermal protector that is provided in the flow channel of hot air has to be arranged at a location that is as remote from the Nichrome wire as possible, i.e., at the root of the radial shape of a mica insulation plate as described above.

Because many limitations are imposed on the dimensions and positions of the space in which a thermal protector is provided as described above, it has been extremely difficult to configure a thermal protector appropriate for an electrical apparatus that generates hot air in a large flow amount by using a high current in which a breaking arc easily occurs, i.e., to configure a thermal protector that prevents an arc from flying.

It is an object of the present invention to provide a thermal protector that solves the above conventional problem, that is embedded in an electrical apparatus generating hot air that prevents an arc occurring between contacts upon opening contacts of an electrical apparatus from causing adverse effects on surrounding members.

In order to solve the above problem, a thermal protector of the present invention is a thermal protector that is used by being arranged in a flow channel of hot air of an electrical apparatus generating hot air and that opens and closes an electric circuit of the electrical apparatus, the thermal protector including a fixed contact coupled to a first terminal that is connected to an external circuit, a movable contact that is arranged at a position facing the fixed contact, a bimetal that inverts a bending-back direction treating a set temperature as a boundary, a movable plate that is engaged with the bimetal, that has one end fixed to the movable contact, that has the other end coupled to a second terminal that is connected to another external circuit so that the movable contact is brought into contact with the fixed contact by an elastic force, and that is fixed to a holding portion of a base in a cantilevered manner, and a bent plate plane formed by being bent at a prescribed angle from a plate plane of the movable plate in a side portion of a tip side from a center portion of the movable plate in a vicinity in which the movable contact of the movable plate is arranged.

The present invention can provide a thermal protector that can perform control so as to prevent not only a breaking arc between contacts but also a breaking arc between conductive portions around the contacts from causing adverse effects by providing a current plate portion by a bent plate plane standing at a prescribed angle with respect to a plane of a movable plate on a side portion of the movable plate so as to guide a stream of a high flow rate to a constant direction even when the thermal protector is embedded in an electrical apparatus that generates hot air of a high flow rate.

DESCRIPTION OF EMBODIMENTS

Figure 1A:
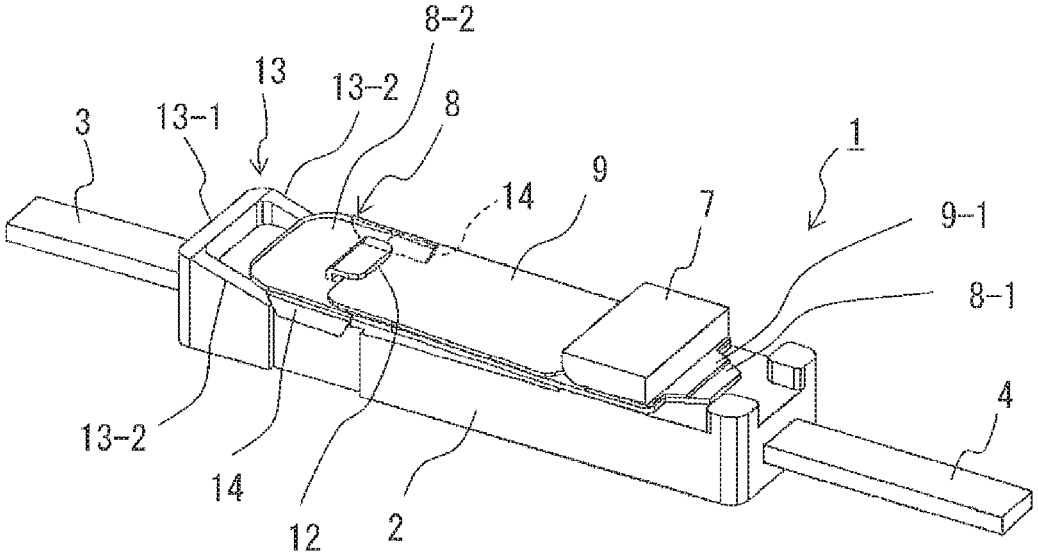
FIG. 1A is an appearance perspective view of a thermal protector according to example 1 of the present invention.

Hereinafter, detailed explanations will be given for the embodiments of the present invention while referring to the drawings.

Example 1

Figure 1B:
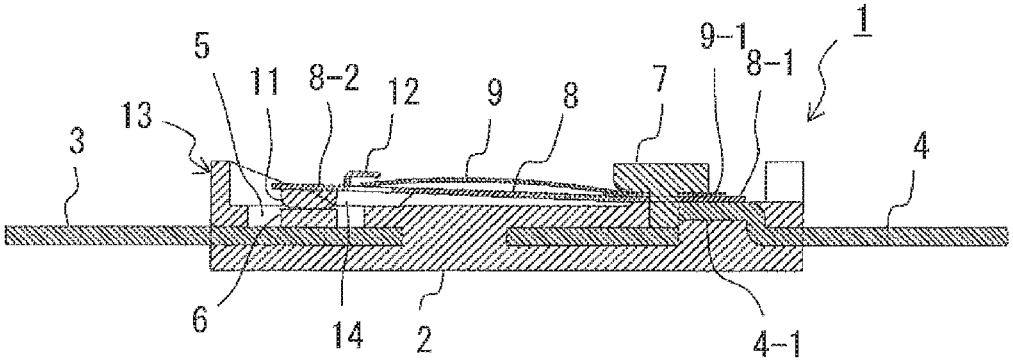
FIG. 1B is a sectional view showing a state before an operation of the thermal protector according to example 1.
Figure 1C:
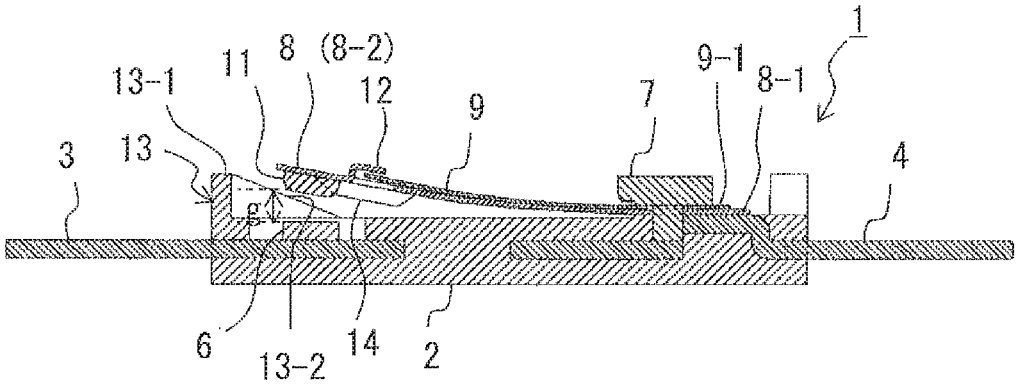
FIG. 1C is a sectional view showing a state after an operation of the thermal protector according to example 1.

FIG. 1A is an appearance perspective view of a thermal protector 1 according to example 1 of the present invention, FIG. 1B is a sectional view showing a state before an operation as a normally closed contact, and FIG. 1C is a sectional view showing a contact-open state after the operation thereof.

This thermal protector according to example 1 is a thermally actuated switch that is arranged and used in a flow channel of hot air of an electrical apparatus generating hot air and that opens and closes an electric circuit of an electrical apparatus. Also, the switch is a thermally actuated switch that brings about further effects when it is used for for example a hair dryer etc. that generates hot air in a large flow amount by using a high current.

As shown in FIG. 1A and FIG. 1B, the thermal protector 1 of example 1 includes a base 2 that is a rectangle made of insulative synthetic resin. A first terminal 3 for the connection with an external circuit (not shown) is fixed to the lower left end in the longitudinal direction of the base 2, and a second terminal 4 for the connection with another external circuit (not shown) is fixed to the lower right end.

As shown in FIG. 1B, the first terminal 3 is formed in such a manner that it is integrated with the base 2 in a shape in which the end fixed to the base 2 is exposed to the bottom surface of an excavated portion 5 formed on the left-vicinity upper surface of the base 2. To the exposed portion of the first terminal 3 at the bottom surface of the excavated portion 5, a fixed contact 6 is fixed.

In the second terminal 4, the end fixed to the right end of the base 2 is bent upward and sideward in two steps and the final end is exposed to the right end upper surface of the base 2 as a terminal exposure portion 4-1. To this terminal exposure portion 4-1, a fixation end 8-1 of the movable plate 8 and a fixation end 9-1 of a bimetal 9 are fixed in a superposed manner by a fixation clasp 7 having a T-shaped cross section.

As the movable plate 8, a material that is a good electrical conductor and that is an elastic body is preferable, and a copper alloy for a general spring is used. As described above, the movable plate 8 is held by being fixed to the second terminal 4 and the right end of the base 2 via the fixation clasp 7 in a cantilevered manner.

Also, on the lower surface of a free end 8-2 of the movable plate 8 corresponding to the left end of the base 2, a movable contact 11 is arranged at the position facing the fixed contact 6 in a fixed manner.

The bimetal 9 has a shape resulting from being superposed on the movable plate 8 and has the right fixation end 9-1 fixed to the right end of the base 2 via the fixation clasp 7 in a cantilevered manner as described above, while having the left free end engaged with the free end 8-2 of the movable plate 8 corresponding to the left end of the base 2.

This engagement between the bimetal 9 and the movable plate 8 is formed by the free end tip of the bimetal 9 entering the space below the bent portion of a bimetal engagement claw 12 formed by a cutting process, a pulling process, and a bending process and the movable plate 8 that is behind the movable contact 11.

The bimetal 9 is a thermally actuated element that inverts the bending-back direction by using a preset temperature as a boundary. The inverting direction of the bimetal 9 shown in FIG. 1B is a direction in which the convex shape is toward the outer side of the thermal protector 1 (upward direction in FIG. 1B).

Under normal circumstances, the entire bimetal 9 is inverted in its entirety to form a convex shape toward the outside while having the right end fixed to the right end of the base 2 in a cantilevered manner, and accordingly the left free end tip is biasing the free end 8-2 of the movable plate 8 as if it is pressing it to the inner side of the thermal protector 1 (lower direction in FIG. 1B).

Thereby, the movable plate 8 is pressing the movable plate 11 so as to bring it into contact with the fixed contact 6 through an appropriate contacting force based on its elastic force. Because this thermal protector 1 is a normally closed switch, the state in which the movable contact 11 and the fixed contact 6 shown in FIG. 1B are in contact with each other is a normal state.

In other words, it is a state before operations as a switch. In this state, between the first terminal 3 and the second terminal 4, a state is formed in which a current can be conducted from an external circuit via the movable contact 11 and the fixed contact 6.

By contrast, the state in which the movable contact 11 and the fixed contact 6 are separated as shown in FIG. 1C, i.e., a state when the contact is open, is due to the bimetal 9 having been thermally actuated by a change of an ambient temperature to a prescribed high temperature and inverted to form a concave shape toward the above from the normal state.

This shows a state in which the entirety of the bimetal 9 is inverted to form a concave shape toward the outside with the bimetal 9 having its right end fixed to the right end of the base 2 in a cantilevered manner so that the left free end tip lifts the free end 8-2 of the movable plate 8 to the outside of the thermal protector 1 and the contact has been opened, i.e., a state after an operation as a switch.

In this thermal protector 1, at the left end of the base 2, partition walls 13 (13-1, 13-2) that enclose the installation portions of the movable contact 11 and the fixed contact 6 from three directions are provided. The partition walls 13 are formed as closely to the fixed contact 6 and the movable contact 11 as possible in a scope such that they do not hinder the contact operations of opening and closing of the fixed contact 6 and the movable contact 11.

Also, the partition walls 13 are formed to be higher at least than the height of the fixed contact 6. In other words, even in the case of the partition wall 13-2, which is relatively lower on both sides of the three directions, it is formed to be higher than the height of the fixed contact 6.

Also, at least the partition wall 13-1 at the center portion of the three directions of the partition walls 13 is configured to have a height greater than contact gap g between the fixed contact 6 and the movable contact 11 when the contact is open and not exceeding the height of the end of the free end 8-2 of time movable plate 8 when the contact is open as shown in FIG. 1C.

Thereby, it is difficult for air to flow into the space between contacts under a flow rate of the hot air, preventing a breaking arc during discharge between contacts at the moment the current is blocked from being blown away by the flowing air to leave the space between the contacts so as to scatter to the surrounding electricity passing members.

A configuration in which a thermal protector does not have a member such as the partition wall 13 that limits the entering of flowing air to contact parts leads to a possibility that a breaking arc that has occurred will fly to the Nichrome wire, which is the antipole to the contact parts, to melt the Nichrome wire, particularly when the airflow direction is not stable and is changing frequently.

Generally, a hair dryer has an air feeding unit at the rear end, and it feeds air into the inside by rotating a propeller by using a motor. Air that is fed is in a swirl flow, and thus a current plate facing in the direction opposite to the swirl flow is provided inside in some cases.

However, partially because just providing a current plate does not cause a parallel flow and there is influence by other components arranged inside, hot air flowing around the thermal protector forms a complicated stream in the hair dryer. When a breaking arc having occurred in this situation is blown away by flowing air, it enters an unstable state, causing a malfunction such as the arc flying to other conductive members.

Incidentally, as described above, it is assumed that the thermal protector 1 of the present example brings about further effects when it is used by being arranged in for example the flow channel of hot air of an electrical apparatus, causing hot air in a large flow amount through using a high current, e.g., in a hair dryer.

Accordingly, because when the breaking arc occurring in order to block a high current when blocking an electric circuit while passing an electricity is greater than in a case of a normal temperature switch and because the flow amount of the hot air is large, there is a possibility that the breaking arc will be blown away by a flowing air to leave the space between the contacts so as to scatter to surrounding electricity passing members even when the contact part has the partition wall 13.

In case of a hair dryer particularly, a complicated air stream has been formed inside as described above. Thus, there is a higher possibility that the breaking arc will be blown away by flowing air, leaving the space between the contacts and reaching the surroundings.

Accordingly, in the present embodiment, in the vicinity, in the movable plate 11, in which the movable contact 11 is arranged, from the center portion side of the movable plate 8 to the free end 8-2 side, and in both side portions thereof, bent plate planes 14 that are bent at a prescribed angle from the plate plane of the movable plate 8 (a right angle in the examples of FIG. 1A, FIG. 1B and FIG. 1C) are formed.

These bent plate planes 14 can be formed by providing protruding portions on both sides of the end, of the rectangular movable plate 8, to which the movable contact 11 is attached and bending these protruding portions onto the plane side on which the movable contact 11 is arranged at a right angle with respect to this plane.

When the bent plate planes 14 are formed by bending them onto the plane side on which the movable contact 11 is arranged as described above, the bent plate planes 14 are formed in such a manner that they are arranged at constant intervals so that the bent plate planes 14 will not come into contact with the base 2. Also, the height of the bent plate planes 11 is assumed to be one that does not exceed ½ of the approximate width of the movable plate 8.

When a current is blocked, i.e., when contacts are open as shown in FIG. 1C, the movable plate 8 is in a cantilevered state at the fixation end 8-1 of the right end, and accordingly forms a great displacement toward the left end, which is a free end. By contrast, around the vicinity of the center portion of the movable plate 8, a displacement does not become so great.

Accordingly, even when the movable plate 8 is displaced so as to open upward, both ends of the movable plate 8 limit the air flow of the contact part by the bent plate planes 14 and the partition wall 13-2 of the base 2, and thus, even when hot air flows in a large flow amount around the thermal protector 1, it is possible to limit the air flowing into the contact part.

Thereby, a breaking arc having occurred between contacts is not expanded by flowing air and thus a breaking arc does not cause failure by flying from the contact part to a conductive portion that is not a contact part.

When for example the thermal protector 1 in a hair dryer is attached in such a direction that the airflow direction and the longitudinal direction of the base 2 are the same and the left end (contact part) is directed to the outlet of the air, it is possible to limit the flowing of the air into the contact part when the bent plate planes 14 exist on both sides of the movable plate 8.

Note that too large a height of the bent plate planes 14 increases the weight of the tip side of the movable plate 8, sometimes causing not only adverse effects of reducing the opening/closing speed of contacts but also a malfunction of a breaking arc flying to the bent plate planes 14.

Figure 2A:
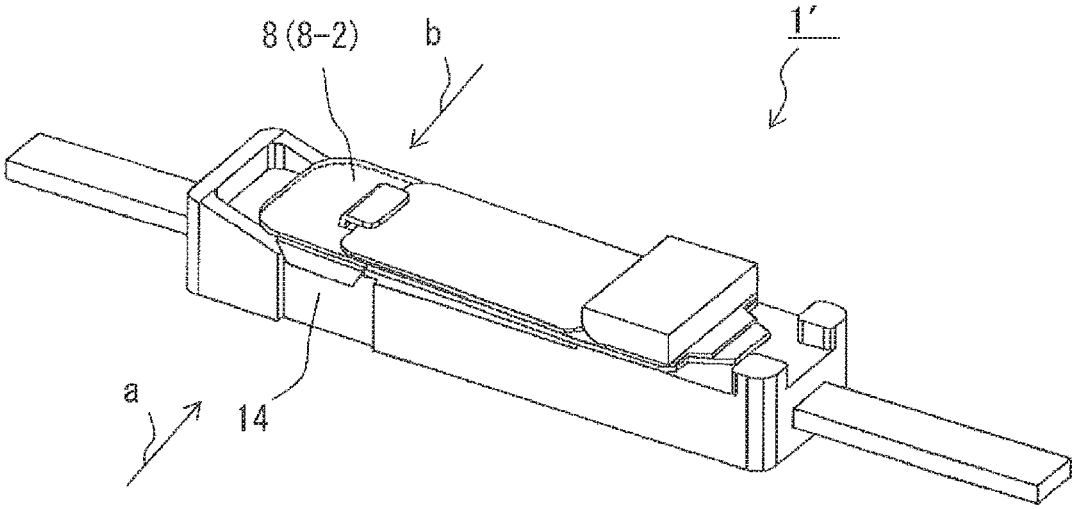
FIG. 2A is an appearance perspective view showing variation example 1 of the thermal protector according to example 1.
Figure 2B:
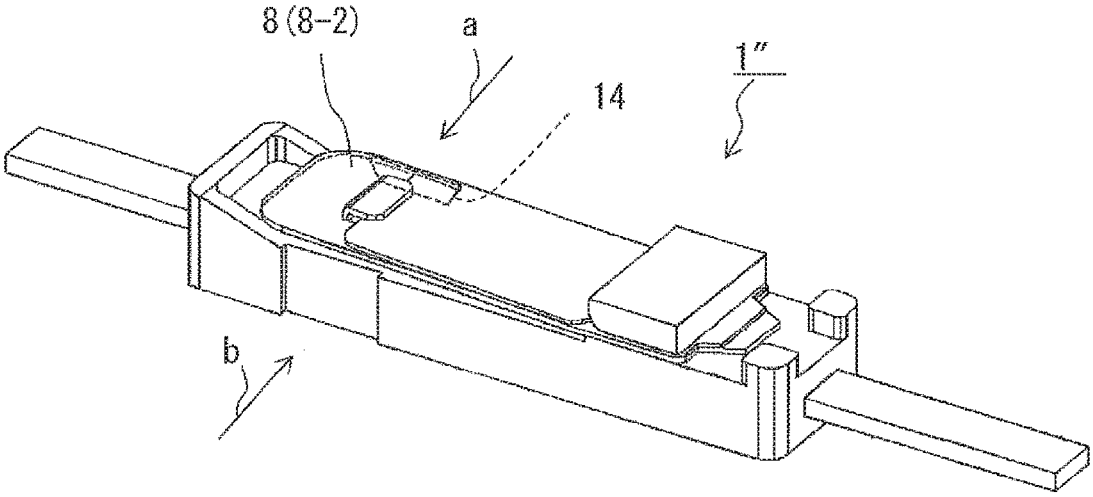
FIG. 2B is an appearance perspective view showing variation example 2 of the thermal protector according to example 1.

FIG. 2A is an appearance perspective view showing variation example 1 of the thermal protector 1 according to example 1 above, and showing a configuration in which the bent plate plane 14 is formed only in the left side portion with respect to the free end 8-2 of the movable plate 8. FIG. 2B is an appearance perspective view showing variation example 2, and showing a configuration in which the bent plate plane 14 is formed only in the right side portion with respect to the free end 8-2 of the movable plate 8.

Note that the configurations shown in FIG. 2A and FIG. 2B are similar to the cases of FIG. 1A, FIG. 1B and FIG. 1C, excluding the position at which the bent plate plane 14 is formed, and the same numbers as those in FIG. 1A, FIG. 1B and FIG. 1C are assigned to constituents that are necessary for the explanations, and no numbers are assigned to the other constituents.

The configuration of a thermal protector 1' shown in FIG. 2A or thermal protector 1" shown in FIG. 2B show a configuration of a case where the attachment direction of the thermal protector 1' or the thermal protector 1" in the hair dryer is such that the longitudinal direction of the base 2 is at a right angle with respect to the airflow direction.

However, when the thermal protector 1' or 1" is attached so that the longitudinal direction of the base 2 is at a right angle with respect to the airflow direction as described above, flowing air can be shielded when the bent plate plane 14 exists on the windward side. The airflow directions from the windward side in such a case are denoted by arrows a in both FIG. 2A and FIG. 2B.

By contrast, attaching a thermal protector in a wrong direction so that the bent plate plane 14 exists on the leeward side leads to a possibility that the breaking arc may fly to the portion of this bent plate plane 14. The airflow directions from the windward side in such a case are denoted by arrows b in both FIG. 2A and FIG. 2B. Accordingly, attaching the thermal protector 1' or 1" to a hair dryer requires caution.

Example 2

Figure 3A:
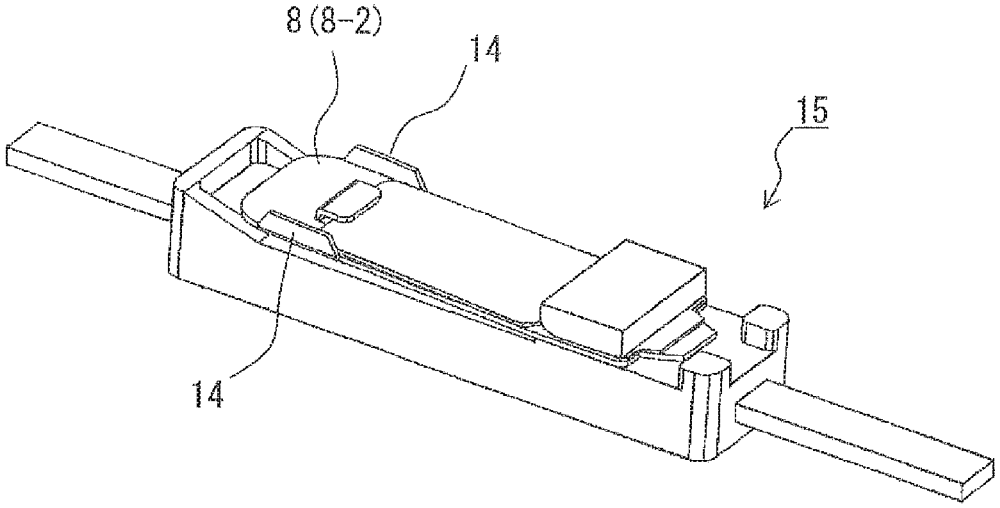
FIG. 3A is an appearance perspective view of a thermal protector according to example 2 of the present invention.
Figure 3B:
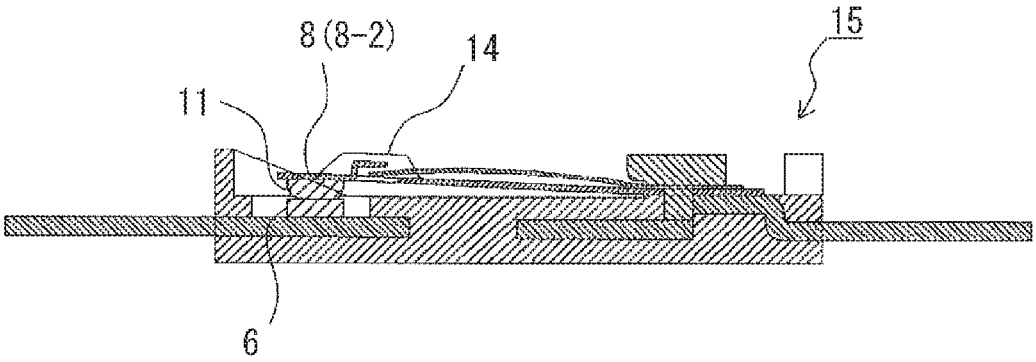
FIG. 3B is a sectional view showing a state before an operation of the thermal protector according to example 2.
Figure 3C:
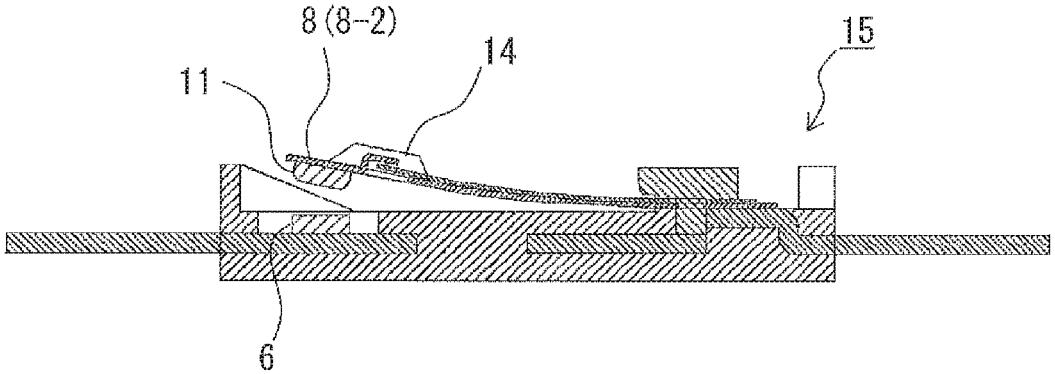
FIG. 3C is a sectional view showing a state after an operation of the thermal protector according to example 2.

FIG. 3A is an appearance perspective view of a thermal protector 15 according to example 2 of the present invention, FIG. 3B is a sectional view showing a state before an operation as a normally closed contact, and FIG. 3C is a sectional view showing a contact-open state after the operation thereof.

Note that the configurations shown in FIG. 3A, FIG. 3B and FIG. 3C are similar to the cases of FIG. 1A, FIG. 1B and FIG. 1C excluding the direction in which the bent plate plane 14 is formed, and the same numbers as those in FIG. 1A, FIG. 1B and FIG. 1C are assigned to constituents that are necessary for the explanations, and no numbers are assigned to the other constituents.

According to the present embodiment as well, as shown in FIG. 3A, FIG. 3B and FIG. 3C, in the vicinity, in the movable plate 8, in which the movable contact 11 is arranged, from the center portion side of the movable plate 8 to the free end 8-2 side, and in both side portions thereof, bent plate planes 14 that are bent at a prescribed angle from the plate plane of the movable plate 8 (a right angle in the examples of FIG. 3A, FIG. 3B and FIG. 3C) are formed.

In this case as well, the bent plate planes 14 are formed by providing protruding portions on both sides of the end, of the rectangular movable plate 8, to which the movable contact 11 is attached and bending these protruding portions. However, in the present embodiment, the bent plate planes 14 are formed on the opposite side plane of the movable contact 11, i.e., in the jumping direction of the member 8-2 in the above example.

When the bent plate planes 14 are formed on the opposite side plane of the movable contact as described above, a case is considered where the attachment direction of the thermal protector 15 in a hair dryer is such that the longitudinal direction of the base 2 is the same as the airflow direction and the end having the contact part is directed to the air outlet.

In such a case, because air is flowing from the rear direction of the thermal protector 15, i.e., from the opposite side of the contact part even after an operation, it is possible to adjust the flow direction of hot air flowing around the contacts so that it becomes parallel to the base 2, i.e. it becomes in a fixed direction that is parallel to the longitudinal direction of the movable plate 8.

It is possible to straighten an airflow flowing along the movable plate 8 on the upper surface of the movable plate 8 particularly from the tip at which the movable contact 11 exists, and even when a breaking arc having flown from the movable contact 11 becomes about to fly from the space between the contacts, exiting the movable plate 8, the direction of the arc is controlled by flowing air that has been adjusted to a fixed direction.

This eliminates a situation where a breaking arc having flown from the movable contact 11 flies to the Nichrome wire in the vicinity of the thermal protector 15, which may occur when the bent plate plane 14 does not exist. Note that the heights of the bent plate planes 14 are limited similarly to the case of example 1.

When a current is blocked, the movable plate 8 jumps to the opposite side of the fixed contact 6 in order to open the contacts, and thus too great a height of the bent plate plane 14 instantaneously reduces the insulation distance from conductive portions, which are Nichrome wire in may cases, around the thermal protector 15.

In FIG. 3A, FIG. 3B and FIG. 3C, the bent plate planes 14 are bent at a right angle, i.e., 90 degrees, with respect to the plate plane of the movable plate 8. However, the invention is not limited to this, and when for example the longitudinal direction of the thermal protector 15 is parallel to the flow direction of the hot air and the contact side is directed to the air outlet, the bent plate planes 14 function as current plates as long as the bending angle of the bent plate planes 14 is equal to or greater than 45 degrees even when the bending angle of the bent plate planes 14 is smaller than 90 degrees, and this thereby reduces cases where the effects of stabilizing the airflow direction are deteriorated.

Figure 4A:
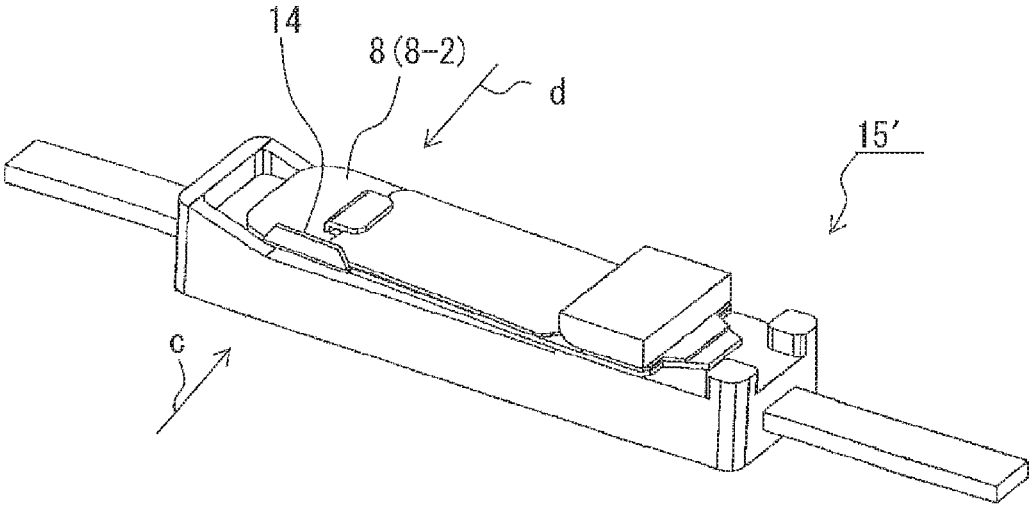
FIG. 4A is an appearance perspective view showing variation example 1 of the thermal protector according to example 2.
Figure 4B:
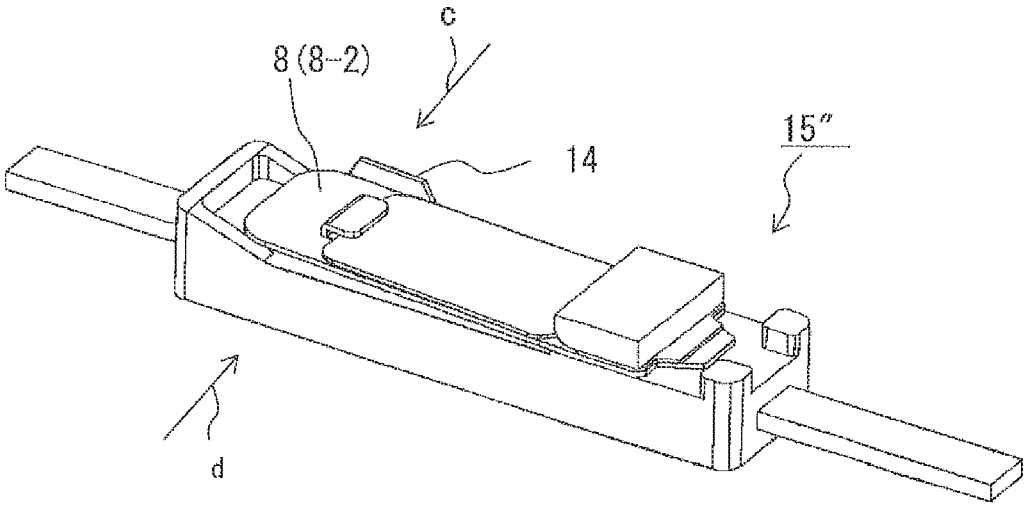
FIG. 4B is an appearance perspective view showing variation example 2 of the thermal protector according to example 2.

FIG. 4A is an appearance perspective view showing variation example 1 of the thermal protector 15 according to example 2 above, and showing a configuration in which the bent plate plane 14 is formed only in the left side portion with respect to the free end 8-2 of the movable plate 8. FIG. 4B is an appearance perspective view showing variation example 2, and showing a configuration in which the bent plate plane 14 is formed only in the right side portion with respect to the free end 8-2 of the movable plate 8.

Note that the configurations shown in FIG. 4A and FIG. 4B are similar to the cases of FIG. 3A, FIG. 3B and FIG. 3C, excluding the position at which the bent plate plane 14 is formed, and the same numbers as those in FIG. 3A, FIG. 3B and FIG. 3C are assigned to constituents that are necessary for the explanations, and no numbers are assigned to the other constituents.

The configuration of a thermal protector 15' shown in FIG. 4A or thermal protector 15" shown in FIG. 4B show a configuration of a case where the attachment direction of the thermal protector 15' or the thermal protector 15" in the hair dryer is such that the longitudinal direction of the base 2 is at a right angle with respect to the airflow direction.

However, when the thermal protector 15' or 15" is attached so that the longitudinal direction of the base 2 is at a right angle with respect to the airflow direction as described above, the flow rate on the upper surface side of the movable plate 8 becomes unstable when the bent plate plane 14 is on the windward side, but the flow rate on the movable contact 11 side remains high, and thus the arc flows to the leeward side stably without flying to other conductive components. The airflow directions from the windward side in such a case are denoted by arrows c in both FIG. 4A and FIG. 4B.

By contrast, attaching a thermal protector 15' or 15" in a wrong direction so that the bent plate plane 14 exists on the leeward side leads to a possibility that the stream will become unstable on the leeward side of the movable plate 8, i.e. on the air outlet side of a hair dryer, resulting in deterioration in the function of the hair dryer. The airflow directions from the windward side in such a case are denoted by arrows d in both FIG. 4A and FIG. 4B.

Accordingly, attaching the thermal protector 15' or 15" to a hair dryer requires caution. In any event, when the thermal protector is attached in such a manner that the longitudinal direction of the base 2 is at a right angle with respect to the airflow direction, it is desirable that the bent plate plane 14 of the tip of the movable plate 8 be either of them depending upon the airflow direction as in the thermal protector 15' or 15". It is also desirable that the bending angle of the bent plate plane 14 be a right angle.

Generally, for electrical appliances that have a large amount of flowing air, particularly appliances such as a hair dryer, there are appliances that switch between 120V and 250V or appliances that are designed for different voltages by the setting of the heat generation bodies even when they have the same configuration. Also, there are appliances whose occurrence of breaking arcs varies even if they have the same amount of flowing air, and the control of breaking arcs is an important problem when thermal protectors are to be embedded.

However, the installation environments are becoming more harsh for situations in which a thermal protector blocks a high current, such as in a case when the power of the heater becomes greater in order to dry hair in a shorter period of time and thereby the amount of flowing air increases and the air outlet is narrowed with a nozzle in order to further increase a flow rate at the air outlet.

The configurations of the thermal protectors of the present invention have advantages wherein movements of a breaking arc occurring between contacts are controlled so as to prevent malfunctions in a situation with a harsh installation environment as described above.

Note that various modifications can be made in the above embodiments without departing from the spirit of the embodiments. For example, while explanations were given for embodiments in which a bimetal is arranged on the upper surface of the movable plate to facilitate understanding of the operations in the above examples, the bimetal may be arranged on the lower surface of the movable plate.

Also, while the bimetal has its end fixed together with the movable plate in the embodiments, the embodiments are not limited to this example. When the bimetal is not fixed, a configuration will be employed in which a claw, a protruding portion, etc. at a center portion for supporting the bimetal being inverted is added as necessary.

While some embodiments have been explained above, the present invention is included in the scope of the inventions described in the claims and their equivalents. Below, the inventions described in the original claims of the present application as filed are added as appendixes.

APPENDIXES

Appendix 1 A thermal protector that is used by being arranged in a flow channel of hot air of an electrical apparatus generating hot air and that opens and closes an electric circuit of the electrical apparatus, the thermal protector comprising a fixed contact coupled to a first terminal that is connected to an external circuit;

a movable contact that is arranged at a position facing the fixed contact;

a bimetal that inverts a bending-back direction treating a set temperature as a boundary;

a movable plate that is engaged with the bimetal, that has one end fixed to the movable contact, that has the other end coupled to a second terminal that is connected to another external circuit so that the movable contact is brought into contact with the fixed contact by an elastic force, and that is fixed to a holding portion of a base in a cantilevered manner; and a bent plate plane formed by being bent at a prescribed angle from a plate plane of the movable plate in a side portion of a tip side from a center portion of the movable plate in a vicinity in which the movable contact of the movable plate is arranged.

Appendix 2 A thermal protector according to appendix 1, wherein the bent plate plane is formed by being bent from the movable plate in a direction in which the fixed contact exists.

Appendix 3 The thermal protector according to Appendix 2, wherein the bent plate plane is formed to have a height that does not exceed a height of the fixed contact.

Appendix 4 The thermal protector according to Appendix 1, wherein the bent plate plane is formed by being bent from the movable plate in a direction opposite to a direction in which the fixed contact exists.

Appendix 5 The thermal protector according to Appendix 4, wherein the bent plate plane is formed to have a height that does not exceed ½ of a plate width of the movable plate.

Appendix 6 The thermal protector according to Appendix 1, wherein the bent plate planes are formed in both side portions of the movable plate.

Appendix 7 The thermal protector according to Appendix 1, wherein the bent plate plane is formed in one of side portions of the movable plate.

Appendix 8 The thermal protector according to Appendix 6, wherein the bent plate plane is formed by being bent at a bending angle between 45 degrees and 90 degrees with respect to the plate plane of the movable plate.

Appendix 9 The thermal protector according to Appendix 7, wherein the bent plate plane is formed by being bent at a bending angle between 45 degrees and 90 degrees with respect to the plate plane of the movable plate.

INDUSTRIAL APPLICABILITY

The present invention can be embedded in an electrical apparatus that generates hot air so as to be used for a thermal protector that prevents adverse effects on surrounding members, caused by an arc occurring between contacts when the contacts are open in the electrical apparatus.

SYMBOLS

1, 1', 1" THERMAL PROTECTOR
2 BASE
3 FIRST TERMINAL
4 SECOND TERMINAL
4-1 TERMINAL EXPOSURE PORTION
5 EXCAVATED PORTION
6 FIXED CONTACT
7 A FIXATION CLASP
8 MOVABLE PLATE
8-1 FIXATION END
8-2 FREE END
9 BIMETAL
9-1 FIXATION END
11 MOVABLE CONTACT
12 BIMETAL ENGAGEMENT CLAW
13 (13-1, 13-2) PARTITION WALL
14 BENT PLATE PLANE
15, 15', 15" THERMAL PROTECTOR

What is claimed is:

1. A thermal protector that is used by being arranged in a flow channel of hot air of an electrical apparatus generating hot air and that opens and closes an electric circuit of the electrical apparatus, the thermal protector comprising:

a fixed contact coupled to a first terminal that is connected to the electric circuit;

a movable contact that is arranged at a position facing the fixed contact;

a bimetal that inverts at a set temperature;

a movable plate that is engaged with the bimetal, the movable plate extending in a longitudinal direction from a free end to a fixed end, wherein the free end is fixed to the movable contact and the fixed end is coupled to a second terminal that is connected to the electric circuit so that the movable contact is brought into contact with the fixed contact by an elastic force, wherein the movable plate is fixed to a holding portion of a base in a cantilevered manner; and a bent plate plane formed by a portion of the movable plate proximate the movable contact being bent at a prescribed angle from a plate plane of the movable plate, wherein the bent plate plane is formed only in one of a first side portion and a second side portion of the movable plate, wherein the movable plate extends from the first side portion to the second side portion in a direction orthogonal to the longitudinal direction, wherein the bent plate plane limits an air flow of a contact part of the fixed contact and the movable contact when the contacts are open by being formed by being bent from the movable plate in a direction in which the fixed contact exists or adjusts a flow direction of hot air so that the flow direction becomes in a fixed direction that is parallel to the longitudinal direction of the movable plate by being formed by being bent from the movable plate in a direction opposite to a direction in which the fixed contact exists.

2. The thermal protector according to claim 1, further comprising a partition wall that encloses an installation portion of the movable contact and the fixed contact from three directions, wherein the partition wall is formed so that the partition wall has a height greater than a height of the fixed contact and so that at least a center portion of the partition wall has a height not exceeding a height of the free end of the movable plate when contacts of the fixed contact and the movable contact are open, and the bent plate plane is bent from the movable plate in a direction in which the fixed contact exists and limits an air flow of a contact part of the fixed contact and the movable contact together with the partition wall when the contacts are open.

3. The thermal protector according to claim 2, wherein the bent plate plane is formed to have a height that does not exceed a height of the fixed contact.

4. The thermal protector according to claim 1, wherein the bent plate plane is formed to have a height that does not exceed ½ of a plate width of the movable plate.

5. The thermal protector according to claim 1, wherein the bent plate plane is formed by being bent at a bending angle between 45 degrees and 90 degrees with respect to the plate plane of the movable plate.

* * * * *